United States Patent [19]

You

[11] Patent Number: 4,740,670

[45] Date of Patent: Apr. 26, 1988

[54] ELECTRIC FAN HEATER FOR CIRCULATING AND/OR HEATING AIR

[75] Inventor: Chy H. You, Taipei, Taiwan

[73] Assignee: Taiwan Electric Heating Equipment Co. Ltd., Taipei, Taiwan

[21] Appl. No.: 887,233

[22] Filed: Jul. 21, 1986

Related U.S. Application Data

[63] Continuation-in-part of Ser. No. 850,707, Apr. 11, 1986, abandoned.

[51] Int. Cl.[4] ..... F24H 3/06; H05B 3/00; H05B 1/02

[52] U.S. Cl. ..... 219/370; 219/364; 219/366; 219/375; 219/530; 219/540

[58] Field of Search ..... 219/363–372, 219/373–377, 379–382, 530, 540

[56] References Cited

U.S. PATENT DOCUMENTS

| | | | |
|---|---|---|---|
| 2,109,279 | 2/1938 | Soverhill | 219/365 |
| 2,455,839 | 12/1948 | Waltom | 219/375 X |
| 2,509,137 | 5/1950 | Denman | 219/371 |
| 2,839,657 | 6/1958 | Mast | 219/367 X |
| 3,020,386 | 2/1962 | Naxom | 219/372 |
| 3,481,534 | 12/1969 | Price | 219/373 X |
| 4,117,308 | 9/1978 | Boggs et al. | 219/530 X |

FOREIGN PATENT DOCUMENTS

| | | | |
|---|---|---|---|
| 2535029 | 4/1984 | France | 219/368 |

*Primary Examiner*—Anthony Bartis

[57] ABSTRACT

A multiuse fan includes a housing enclosing an electrically driven fan for providing a flow to air from a grilled air inlet to a grilled air outlet through a generally circular electric heater assembly in the housing. The heater assembly includes a grating formed by a plurality of spaced, parallel, radially extending metallic heating plates, each having inner and outer portions inclined with respect to each other and which form an intermediate ring-like summit portion at the juncture of the inner and outer portions. The inner end of each plate is connected to an inner ring member coaxial with the fan and the outer end of each plate is joined to an outer ring attached to the housing. An electric heating ring member is positioned in an annular groove provided in the summit portion. Controls permit the fan to be engaged alone to merely circulate air or the fan heating ring to be simultaneously energized to heat and circulate the air.

5 Claims, 8 Drawing Sheets

ELECTRIC FAN HEATER FOR CIRCULATING AND/OR HEATING AIR

This application is a continuation-in-part application of U.S. Application Ser. No. 850,707 filed on Apr. 11, 1986, which is now abandoned.

BACKGROUND OF THE INVENTION

The present invention relates to an improved fan with a novel heating device, particularly concerning a fan with a novel grating holding an annular heating device disposed in front of a fan and a controlling switch device for controlling the heating device so that the fan can be used as an ordinary cooling fan or a heating fan.

Generally, a typical heater utilizes a length of coil wound on an insulator to heat up the surrounding element by radiation. However, such a direct radiation method heats slowly and cannot deliver heat very far. Also, the cover housing of the heater is easily damaged so the life time of the heater is rather short.

The heating device which was first applied to the fan was a heating coil which winds around an insulator frame. The frame is mounted behind or in front of the fan impeller, so that the heating energy generated by the heating coil can be transferred to the air as the fan delivers a large volume of air. However, such a heating device heats slowly and cannot warm a large area. To increase the heat energy, the heating coil is commonly wound very tightly on the frame. In this case, when the indrawn air includes impurities, the impurities may be wedged in the gaps of the heating coil. If the impurities are combustible, they will burn easily and may cause other combustibles to burn. If the impurities are conductors, they may cause the heating coil to short circuit and then break due to the high temperature resulting from the short. In addition, since the heating coil which is wound around the frame may result in several different air flow densities, and since the different air flow densities will induce different resistances, the heating coil is often broken due to high temperatures.

Another type of heating device for a fan, which was developed to improve on the above-described disadvantages, includes a fixed frame adapted to be mounted on the fan, a plurality of insulators including a plurality of grooves thereon; and a strip heating member adapted to be coupled to the electrical power source, wound on the insulators by being inserted into the grooves. The device is placed in front of the impeller of the fan. Such kind of strip heating member has a large radiating area, a swift and uniform radiating speed, and impurities will not easily rest on the strip heating member. However, it is difficult and complicated to assemble when it is produced, as the strip heating member has to be retained and fixed firmly in each groove one by one.

SUMMARY OF THE INVENTION

With the above problems in mind, the main object of the invention is to provided an improved fan with a heating device which has a simple and easily assembled construction.

An object of the invention is to provide a fan heater with a grating to hold a heating element by which a space can be heated up even more efficiently.

Another object of the invention is to provide an improved fan having a heating ring with a plurality of plate members extending parallely and radially from the heating ring member and arranged so that their respective two flat surfaces are parallel to the direction in which the fan delivers air, so that the heated air can blow farther and impurities will not rest on the heating member.

A further object of the invention is to provide an improved fan having a plurality of connecting members provided at the inner end of some of the plate members and at the outer end of some of the plate members so that the heating ring member can be fixed to the fan housing firmly and easily when the fan is assembled.

A further object of the invention is to provide an improved fan having a special arrangement on the connecting members of the plate members such that the connecting member has a reduced heat-receiving area to reduce the heat transferred to the fan housing, so that the fan can be used for a long time.

A still further object of the invention is to provide an improved fan having a thermal switch with a sensor which can control the heating ring of the fan to turn off electric power automatically for preventing the fan housing from being overheated when the driving motor is out of operation.

In order to achieve the aforesaid objects as well as other incidental objects and advantages, the invention includes a grilled housing, a motor mounted in the housing, a fan driven by the motor, an electric circuit for controlling the fan and improvements wherein a heating plate means is mounted in the housing and has two portions, the portions being inclined with respect to one another and forming a summit portion, and a heating ring being provided on the summit portion of the plate means to provide heat energy.

In a first preferred embodiment, the invention is characterized in that the heating plate means is a grating disposed in front of the fan in the housing. The grating includes an innermost ring member coaxial with the fan, first narrow plates extending parallelly and radially from the ring member and inclining forward relative to the plane of the innermost ring member, an intermediate ring member connected to free ends of the first narrow plates and having an annular groove, second narrow plates extending parallelly and radially from the intermediate ring member and inclining rearward relative to the plane of the intermediate ring member, and an outermost ring member connected to free ends of the second narrow plates. The heating ring is received securely in the annular groove of the grating.

In a second preferred embodiment of the present invention, the heating means is a heating ring member mounted in the housing provided in front of the fan having a plurality of conducting plate members integrally provided on the heating ring member, extending parallelly and radially from the heating ring member, wherein the plate members are separated from each other at a fixed distance and arranged so that their respective two flat surfaces are parallel to the direction in which the fan delivers air.

A plurality of connecting lug members are provided at the inner end of some of the plate members and at the outer end of some of the plate members so that the whole heating device can be connected with the grilled housing and retained firmly in the housing, wherein each of the connecting lug members has an opening forming a gap for reducing the heat conduction from the plate members to the grilled housing of the fan. In addition, the plate members are in such a shape that two ends of each plate member diverge forwardly from the heating ring member so that the fan impellers are not easily harmed by the heat energy of the plate members.

A thermal switch device with a sensor is provided at the heating means in the above-mentioned two preferred embodiments for turning off the electric power to the heating means automatically based on a maximum limited temperature of the heating means for safety's sake when the fan driving motor is out of operation.

When in use, the improved fan can be used as a ordinary cooling fan by turning on the driving motor of the fan only, and can be used as a heating fan by turning turning on the motor and the heating means simultaneously.

BRIEF DESCRIPTION OF THE DRAWINGS

These and other advantages, objects and features of the invention will become apparent from the following detailed description of the preferred embodiment with reference to the accompanying drawings, wherein.

DETAILED DESCRIPTION OF THE PREFERRED EMBODIMENT

The following is a detailed description of the best presently contemplated embodiment of the invention. This description is not to be taken in a limiting sense, but is made merely for the purpose of illustrating the general principles of the invention.

Figure 1:
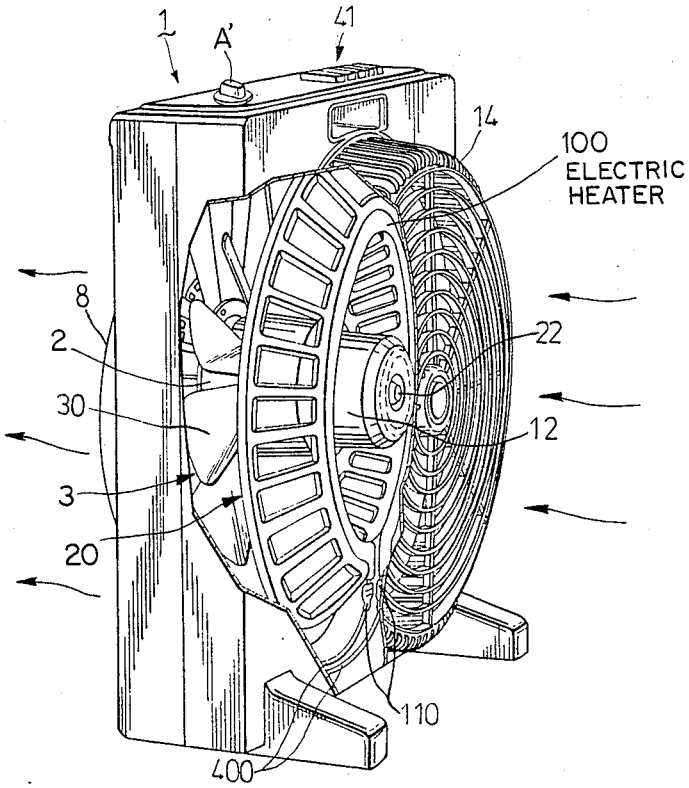
FIG. 1 is a perspective view of a preferred embodiment according to the present invention, wherein the grilled housing of the fan is partially cut-away for showing a grating heating means disposed at the rear portion of the fan.
Figure 2:
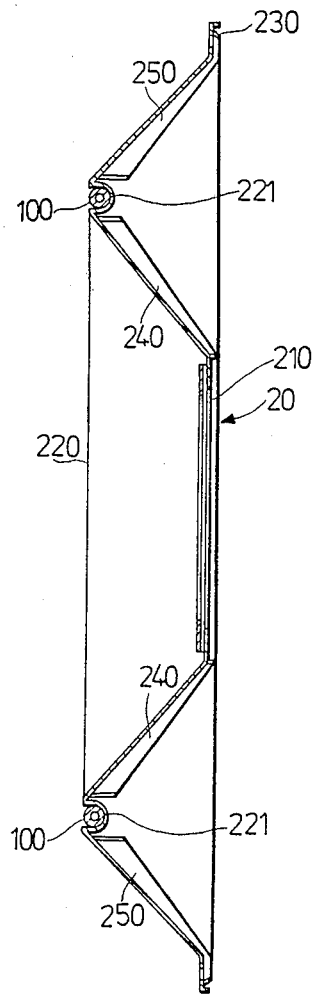
FIG. 2 shows in section the grating heating means of FIG. 1.
Figure 3:
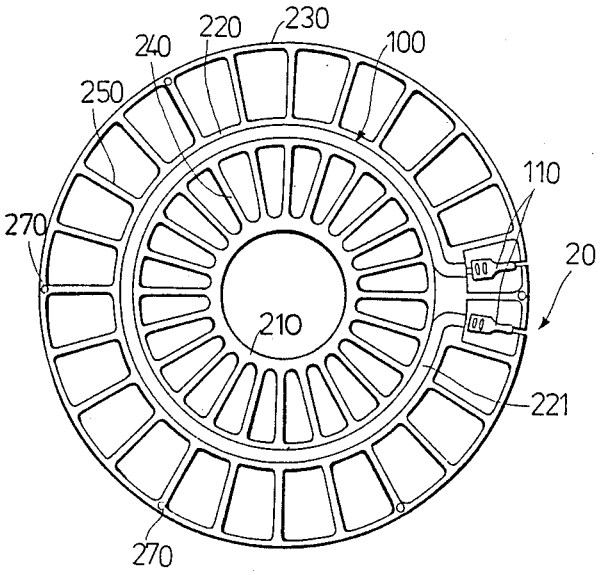
FIG. 3 is a plan view of the grating heating means of FIG. 2.
Figure 4:
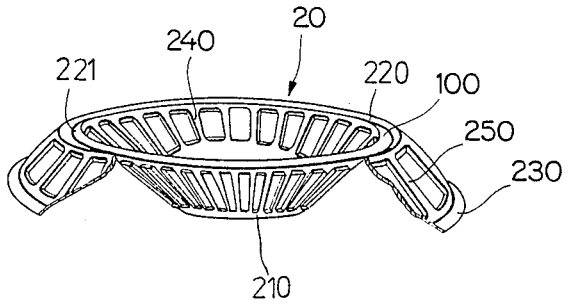
FIG. 4 is a partially sectioned perspective view of the grating heating means of FIG. 2.
Figure 5:
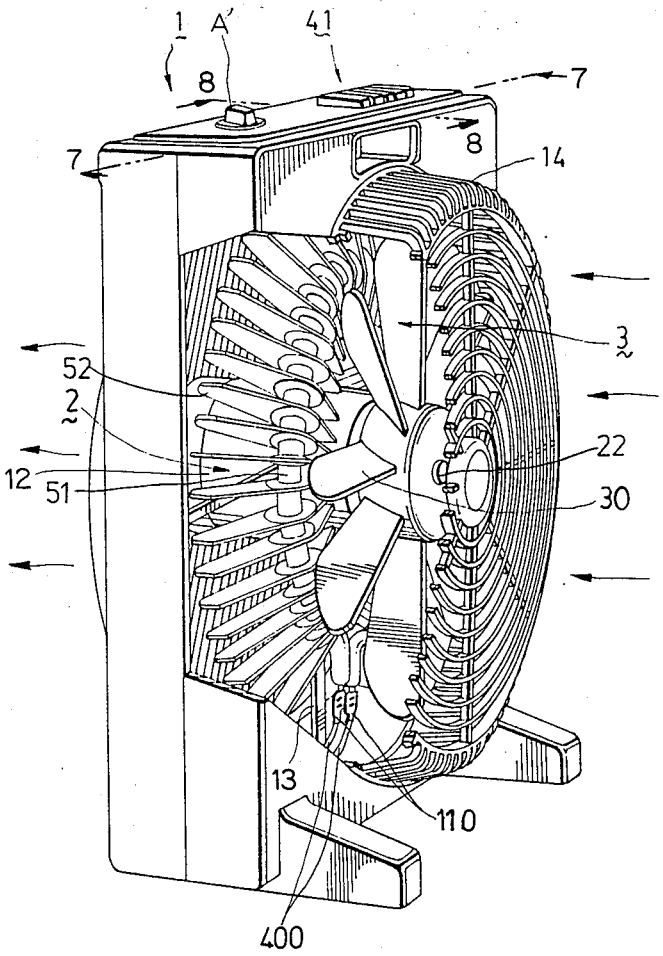
FIG. 5 is a perspective view of another preferred embodiment according to the present invention, wherein the grilled housing of the fan is partially cut-away for showing the inner arrangement of the fan impellers and the heating means.

Referring to FIG. 1 in conjunction with FIGS. 2-4, a first preferred embodiment of the invention includes a grilled housing 1, a motor 2 mounted in a motor retaining casing 12 of the grilled housing 1, a fan 3 with a plurality of fan impellers 30 mounted on a shaft 22 driven by the motor 2, an electric controlling circuit 4 (see FIG. 10) having a controlling switch 41 for controlling the fan to function as a ordinary cooling fan or a heating fan and controlling the speed of the fan, provided on the outer portion of the grilled housing 1, and a heating means 20 mounted in the housing 1 having two inclined portions inclined with respect to one another forming a summit portion.

The improvement of the heating means of the first preferred embodiment is that the heating means is a grating 20 preferably of a metal and has an innermost ring member 210 from which a plurality of narrow baffle plates 240 extend parallelly and radially and incline forward relative to the plane of the ring member 210. The baffle plates 240 are spaced apart, providing spaces for air passage. Outer ends of the baffle plates 240 are connected to an intermediate ring member 220 which has an annular groove 221 receiving securely an annular heating ring 100.

There are narrow baffle plates 250 extending parallelly and radially from the intermediate ring member 220 and inclining rearward relative to the plane of ring member 220 so that the heating means has two inclined portions 240, 250 and the groove 221 is provided at the summit portion of the heating means. The baffle plates 250 are spaced apart, providing spaces for air passage. The outer ends of the baffle plates 250 are connected to an outermost member 230 in which are provided screw holes 270.

The heating ring 100 is made conventionally and includes a circular tube enclosing a circular heating coil and an insulating element. At the ends of the heating ring 100 are provided terminals 110.

The grating heating means 20 is screwed to the rear portion of the housing 1 by means of screw holes 270 and attaching screws (not shown). The terminals 110 of the heating ring 100 are connected to two conductors 400 which will be connected to an electric source.

FIGS. 5-9 show a second preferred embodiment of the present invention, wherein the improvement is in the heating means, which includes a heating ring member 51 and a plurality of conducting plate members 52 integrally provided on the heating ring member 51, and extending parallelly and radially therefrom, wherein the plate members 52 are separated from each other a fixed distance and are arranged so that their respective two flat surfaces are parallel to the direction in which the fan delivers air.

The grilled housing 1 is in a rectangular shape with a large annular passage 11 at the front of the housing 1. A fixed motor retaining casing 12 with a plurality of integrally and radially extending arms 13 is provided at the center of the annular passage 11 for receiving and retaining the motor 2. The extending arms 13 of the annular retaining casing 12 are integrally connected with the inner periphery of the circular passage 11 for reinforcing the extending arms 13 and the motor retaining casing 12. A plurality of projections 121 is integrally provided at the outer periphery of the annular retaining casing 12, each projection 121 being respectively provided between each two adjacent extending arms 13.

A first plurality of connecting lug members 53 is provided at the inner end of some plate members 52. Each connecting lug 53 has a screw hole 10 and connects with the extending projection 121 of the motor retaining casing 12 through a screw 1*a*. The motor 2 can be retained in the motor retaining casing 12 and each of fixing lugs 21 of the motor 2 also can be connected with the extending projection 121 by the screw 1*a* so that the motor 2 can be firmly received in the motor retaining casing 12. A second plurality of connecting lug members 54 is provided at the outer end of some of the plate members 52 adjacent to the inner periphery of the annular passage 11, each connecting lug 54 being connected with the housing 1 by a screw 1*b* so that the heating means can be firmly fixed in front of the fan 3 in the housing 1.

Figure 6:
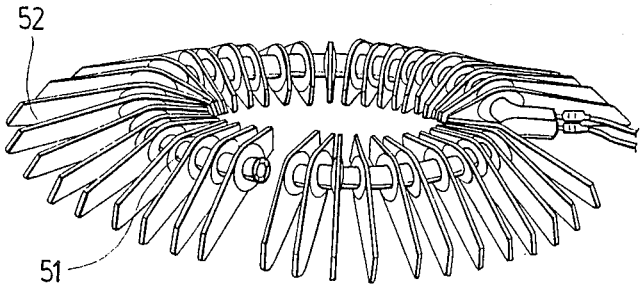
FIG. 6 is a perspective view of the heating means of FIG. 5.
Figure 7:
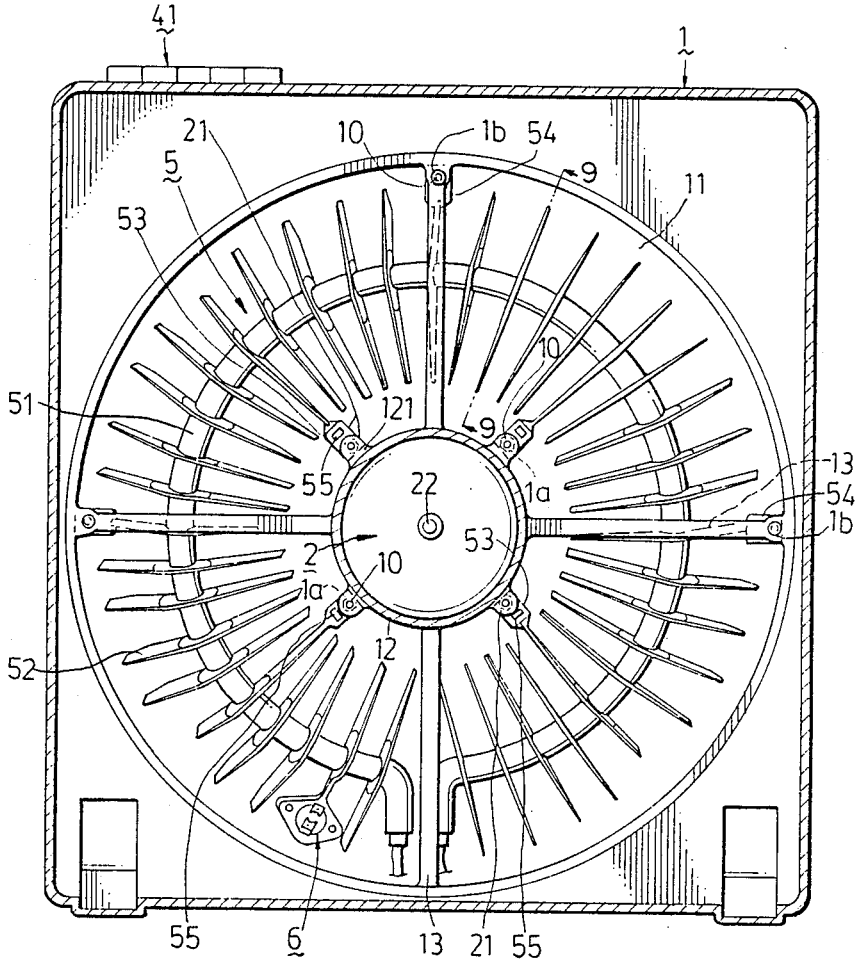
FIG. 7 is a cross-sectional view of FIG. 5 taken along the line 7—7, showing how the conducting plate members of the heating ring member connect with the fan housing through a plurality of connecting lug members.
Figure 8:
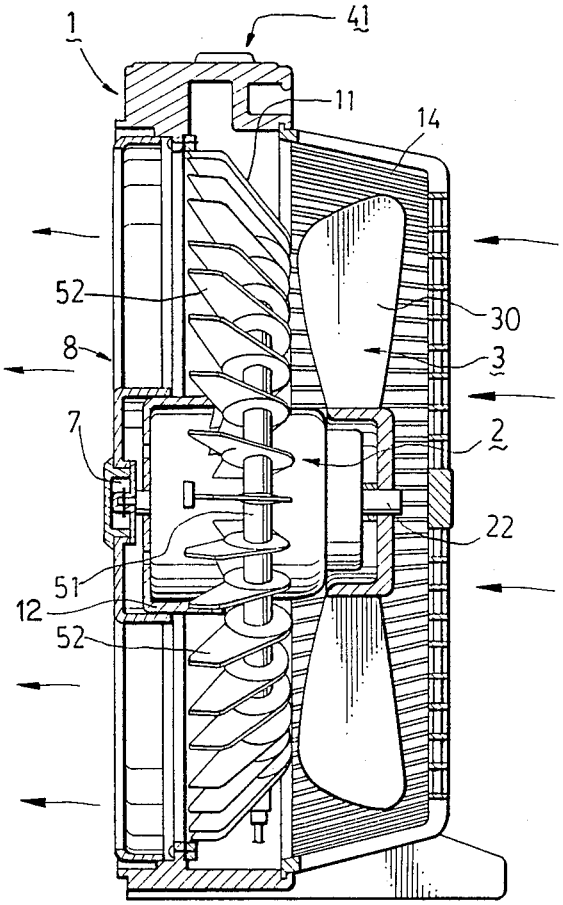
FIG. 8 is a side sectional view of FIG. 5 taken along the line 8—8, showing the conducting plate members of the heating ring member, which radially and parallel extend from the heating ring member and are arranged so that their respective two flat surfaces are parallel to the direction in which the fan delivers air.
Figure 9:
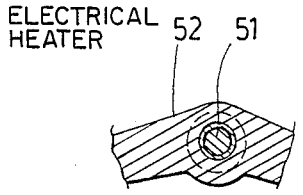
FIG. 9 is an enlarged partial sectional view of the heating ring and conducting plate member taken from the line 9—9 of FIG. 7.

The plate members 52 are made of aluminum and are integrally provided on the heating ring 51 by molding so that the heat energy of the heating ring 51 can easily be conducted throughout the whole heating device. The plate members 52 are in such a shape that two ends of each plate member 52 diverge from the heating ring member 51, towards the front of the fan. In other words, each of the plate members 52 has two inclined portions inclined with respect to one another, forming a summit portion as shown in FIGS. 6, 8, 9, so that the plastic fan impellers 30 are not easily harmed by the heat energy of the plate members 52.

Each of the first and second connecting lug members 53, 54 has an opening 55 to form a gap for reducing the heat conduction from the plate members 52 to the fan grilled housing 1. An insulator washer can be provided at each connecting lug member 53, 54 for reducing the heat energy conducted to the housing 1.

For both the first and second preferred embodiments, the fan further includes a rotating shaft 22 of the motor 2 extending out of the motor with a front end portion and a rear end portion. A reducing mechanism 7 and a rotatable grilled plate 8 which can change the direction of the delivered air from the fan 3 are provided at the front end portion of the motor shaft 2 and a plurality of A.B.S. plastic fan impellers 30 are provided at the rear end portion of the motor shaft 22. A grilled cover 14 connected with the casing 1 covers the plastic impellers 30 of the fan 3.

When the motor 2 operates, the fan impellers 30 draw air in through the rear grilled cover 14, pass it over the heating means and discharge warm air through the front rotatable grilled plate. Since the heating means is provided, cold air can be drawn in efficiently and heated up, and the heated air can be discharged to warm the space efficiently.

Figure 10:
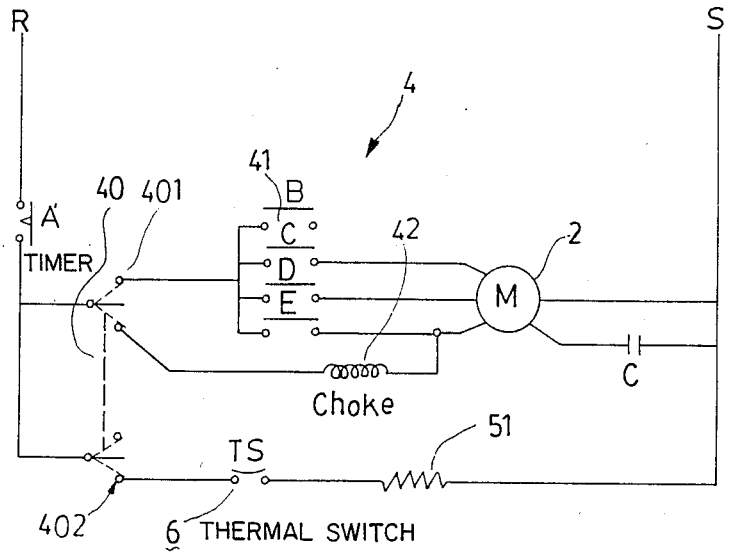
FIG. 10 is a electric circuit diagram for the improved fan according to the present invention used for the two preferred embodiments.

The operation of the fan of the two preferred embodiments can be clearly understood by referring to FIG. 10 which shows the electric circuit 4 and other controlling components. The electric circuit 4 includes a timer switch A', a selecting switch 40 for selecting the function of the fan as an ordinary cooling fan (to connect with terminal 401) or a heating fan (to connect with terminal 402). The controlling switch 41 includes a stop button switch B, and three control button switches C, D, E for strong, intermediate, and weak air-blowing, and a choke 42 can reduce the rotating speed of the motor 2. When the selecting switch 40 is turned on to connect with the terminal 402, electric power can be supplied to the heating means to heat up the heating means. The fan speeds can be selected whether the fan is being operated in a heating function or a cooling function.

A thermal switch device 6 with a sensor is provided at the heating means connecting with the electric circuit 4 for turning off the electric power to the heating means automatically based on the maximum limited temperature of the heating means for safety's sake if the driving motor 2 is out of operation.

While the invention has been described with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

What I claim is:

1. A multiuse fan including a grilled housing having a grilled air inlet and a grilled air outlet, an electric motor mounted in said housing, a fan driven by the motor for causing a flow of air through said housing from said inlet to said outlet, an electric circuit for controlling said motor, a generally circular heating means having a plurality of spaced radially extending heating plates, each plate having two portions which are inclined with respect to each other and which form a summit portion at the connection of said two portions of said radially extending heating plates, and an electric heating ring member provided on said summit portion of said radially extending heating plates, said heating means including a grating including an innermost ring member coaxial with said fan, one portion of said grating being first spaced narrow plates extending parallelly and radially from said innermost ring member and inclining forward relative to the plane of the innermost ring member, an intermediate ring member connected to ends of the first narrow plates, and another portion of said grating being second spaced narrow plates extending parallelly and radially from the intermediate ring member and inclining rearward relative to the plane of said intermediate ring member, and an outermost ring connected to ends of the second narrow plates, said summit portion being formed at the connection of said first narrow plates and said second narrow plates, an annular groove being provided at said summit portion, and said heating ring member being received in said groove.

2. An improved fan as claimed in claim 1, in which said heating ring member and said motor are electrically connected in such a manner that they can be energized simultaneously and that said motor can also be operated alone.

3. An improved fan as claimed in claim 2, including a selector switch for selectively controlling operation of said motor and said fan.

4. An improved fan as claimed in claim 2, wherein said fan has a rotary grill at the air outlet of said housing and operatively connected to said motor, and a grilled cover at the air inlet of said housing.

5. An improved fan as claimed in claim 1, wherein said electric circuit includes a thermal switch device with a sensor for turning off the electric power to said heating ring member automatically based on a maximum limited temperature of said heating means if said driving motor is out of operation.

* * * * *